US008714306B2

(12) United States Patent
Iturbe Beristain

(10) Patent No.: US 8,714,306 B2
(45) Date of Patent: May 6, 2014

(54) PERIMETRIC PROTECTION SYSTEM FOR BUILDINGS UNDERGOING CONSTRUCTION

(75) Inventor: Eneko Iturbe Beristain, Oñati (ES)

(73) Assignee: Ulma CyE, S. Coop., Onati (Guipuzcoa) (ES)

( * ) Notice: Subject to any disclaimer, the term of this patent is extended or adjusted under 35 U.S.C. 154(b) by 175 days.

(21) Appl. No.: 13/074,585

(22) Filed: Mar. 29, 2011

(65) Prior Publication Data

US 2012/0247870 A1 Oct. 4, 2012

(51) Int. Cl.
*E04G 3/20* (2006.01)
*E04G 21/32* (2006.01)

(52) U.S. Cl.
CPC ..... *E04G 3/20* (2013.01); *E04G 21/3261* (2013.01)
USPC ..... 182/137; 182/138; 182/139; 182/140

(58) Field of Classification Search
USPC ..... 182/130–132, 137–140
See application file for complete search history.

(56) References Cited

U.S. PATENT DOCUMENTS

| | | | | | |
|---|---|---|---|---|---|
| 2,450,595 | A | * | 10/1948 | Jones | 182/82 |
| 3,121,470 | A | * | 2/1964 | Stone et al. | 182/129 |
| 3,339,925 | A | * | 9/1967 | Nissen | 473/469 |
| 3,533,487 | A | * | 10/1970 | Norin | 182/19 |
| 4,074,791 | A | * | 2/1978 | Inman | 182/138 |
| 4,119,176 | A | * | 10/1978 | Verdu | 182/138 |
| 4,129,197 | A | * | 12/1978 | Preston | 182/82 |
| 4,290,576 | A | | 9/1981 | Schworer | 249/20 |
| 4,429,764 | A | * | 2/1984 | Park | 182/129 |
| 4,598,794 | A | * | 7/1986 | Anderson | 182/113 |
| 4,624,342 | A | * | 11/1986 | Anderson | 182/223 |
| 4,671,382 | A | * | 6/1987 | D'Alessio et al. | 182/128 |
| 4,805,735 | A | * | 2/1989 | Anderson | 182/138 |
| 4,838,382 | A | * | 6/1989 | Nusbaum | 182/138 |
| 4,856,615 | A | * | 8/1989 | Nusbaum | 182/82 |
| 4,869,343 | A | * | 9/1989 | Anderson | 182/113 |
| 4,892,169 | A | * | 1/1990 | Duncan | 182/138 |
| 4,962,828 | A | * | 10/1990 | Duncan | 182/82 |
| 5,038,889 | A | * | 8/1991 | Jankowski | 182/129 |
| 5,109,953 | A | | 5/1992 | Mathis | 182/129 |

(Continued)

FOREIGN PATENT DOCUMENTS

| | | |
|---|---|---|
| CA | 2613171 | 12/2007 |
| CA | 2718609 | 9/2010 |

(Continued)

*Primary Examiner* — Alvin Chin Shue
*Assistant Examiner* — Colleen M Chavchavadze
(74) *Attorney, Agent, or Firm* — Ostrolenk Faber LLP

(57) ABSTRACT

The present disclosure relates to a perimetric protection system for buildings undergoing construction including at least two masts (1) spaced from one another and each formed by two vertical U-profiles (1); a horizontal platform (3) supported on at least two horizontal beams (300) attached to the masts by means of first attachment elements or anchors (130). The system further comprises:

at least two inclined beams (100) parallel to one another, which are attached:

to the masts (1) by means of at least two second attachment elements (110) forming a first angle (α);

to the horizontal beams (300) by means of at least two third attachment elements (310) forming a second angle (β); and, the at least two inclined beams (100) having a free end (100*a*) in the third attachment elements (310), such that their height is greater than the height of the horizontal platform (2);

an inclined protective panel (120) attached to said at least two inclined beams (100).

8 Claims, 6 Drawing Sheets

(56) References Cited

U.S. PATENT DOCUMENTS

| | | | | |
|---|---|---|---|---|
| 5,161,641 | A * | 11/1992 | Nusbaum | 182/138 |
| 5,299,654 | A * | 4/1994 | Duncan | 182/138 |
| 5,299,655 | A * | 4/1994 | Margaritis | 182/138 |
| 5,429,206 | A * | 7/1995 | Nusbaum | 182/138 |
| 5,778,999 | A * | 7/1998 | Nealeigh | 182/82 |
| 6,035,967 | A * | 3/2000 | Maeda | 182/138 |
| 6,557,666 | B1 * | 5/2003 | Drouin | 182/129 |
| 6,557,817 | B2 | 5/2003 | Waldschmitt et al. | 249/20 |
| 6,698,604 | B2 * | 3/2004 | Denny et al. | 211/189 |
| 7,389,855 | B2 * | 6/2008 | Rexroad | 182/138 |
| 7,513,480 | B2 | 4/2009 | Bergaretxe et al. | 249/20 |
| 8,464,996 | B2 | 6/2013 | Spindler et al. | 249/20 |
| 2006/0225960 | A1 * | 10/2006 | Ferlin et al. | 182/138 |
| 2011/0171336 | A1 | 7/2011 | Schwoerer | 425/63 |
| 2012/0048654 | A1 | 3/2012 | Steward | 187/245 |

FOREIGN PATENT DOCUMENTS

| | | |
|---|---|---|
| EP | 373617 | 6/1990 |
| EP | 2365159 | 9/2011 |
| WO | WO 2004-020766 A1 | 3/2004 |
| WO | WO 2007/036300 A1 | 4/2007 |

* cited by examiner

PERIMETRIC PROTECTION SYSTEM FOR BUILDINGS UNDERGOING CONSTRUCTION

TECHNICAL FIELD OF THE INVENTION

The present invention is comprised in the technical field of construction and, more particularly, in the sector of the perimetric protections for buildings undergoing construction.

BACKGROUND OF THE INVENTION

The proliferation of very tall buildings, such as skyscrapers, in large cities has considerably improved the systems for their construction both in terms of efficiency and safety in recent years. The need to work safely at great heights and to continue working even with adverse meteorological conditions (wind or rain) has made it necessary to install in the periphery thereof, attached to the formworks, perimetric protections which safeguard the physical integrity of workers, as well as the safety of pedestrians and vehicles close to the work site which could be affected by objects and materials from the site undergoing construction.

Historically, these protections were initially built using simple rails which were fastened to the formworks and which, once the job on that floor was finished, were moved to the following floor under construction. However, the concept of protection currently followed seeks to completely cover the periphery of the work site with canvases, boards, panels, meshes, etc. These perimetric protections have been used for a long time and there are very different systems for their assembly and installation at the work site, although in all cases they require a support structure fixed to the formworks, to which structure the protective elements are fastened, i.e., the panels, meshes and the like. In this version, as occurred with the protective rails, once the work was finished on the floor or floors covered by the perimetric protection, the elements forming said protection, such as the metal support structure and the protective panels and meshes, had to be moved manually by means of a crane to the upper floors that had to be protected.

Self-climbing perimetric protections have been developed in recent years, which have means for being moved up and down, such that they are placed on the floors that must be perimetrically protected. Examples of such self-climbing protections can be seen in patent documents WO 2004/020766, WO 2007/036300 and in European patent application EP 10382052.8.

During the construction of a building or the like it is common to use a loading platform; in such case, upon placing such platform in the existing self-climbing formwork systems, the loading platform is outside the perimetric protection and it becomes necessary to specifically protect it.

DESCRIPTION OF THE INVENTION

The object of the present invention is a perimetric protection system.

To solve the drawbacks of current perimetric protection systems in which the loading platforms are outside the perimetric protection and accordingly require their own protective means, such as additional rails, the present invention proposes adding an inclined projecting structure such that the loading platform is included within the internal angle formed by the vertical masts supporting the perimetric protection and the inclined projecting structure, to which projecting structure the protective panels are assembled, the loading platform being fastened at one end to the vertical masts and at the other end to the inclined projecting structure.

Thus, according to the present invention, the perimetric protection system for buildings undergoing construction comprises:

- at least two vertical masts spaced from one another and each of these masts formed by two profiles;
- a horizontal loading platform, which can have a variable width depending on needs, supported on at least two horizontal beams attached to the masts by means of first attachment elements or anchors.

A first aspect of the present invention relates to the system further comprising:

- at least two inclined projecting beams parallel to one another;
- the at least two inclined projecting beams being attached to the masts by means of at least two second attachment elements forming a first angle $\alpha$;
- the at least two inclined projecting beams being attached to the horizontal beams by means of at least two third attachment elements forming a second angle $\beta$, which will normally be $\pi/2-\alpha$; and,
- the at least two inclined projecting beams having a free end which amply exceeds the level of the loading platform to create an ample and sufficient protective area which includes the loading platform itself;

the system further including:

- protective panels attached to said at least two inclined beams.

Said vertical masts can each be formed preferably by U-profiles open towards opposite lateral sides. Between the U-profiles there are blocks serving to support the masts in the respective support heads anchored to the floors, as well as to actuate the hoisting means.

Said at least two inclined projecting beams are each preferably made up of two attached U-profiles open towards opposite sides.

The second attachment elements and the third attachment elements can be fixed attachments and, in such case, the first angle $\alpha$ and the second angle $\beta$ are also fixed.

It is also possible for said first and second attachment elements to be articulated attachments; in such case, the first angle $\alpha$ and the second angle $\beta$ are variable.

The system of the invention can further comprise a reinforcing tensioning device, if necessary, between the at least two horizontal beams and the free end of the at least two inclined beams.

The system preferably also comprises vertical protective panels attached to the at least two masts.

By means of the perimetric protection system of the invention, in addition to allowing the loading platform to be comprised within the perimetric protection, other important effects and advantages are achieved both at the operative level and the commercial level. The first is that since each pair of masts and inclined projecting beams form a perimetric protection module and since the perimetric protection modules can be positioned one after the other with virtually nil or very little separation between adjacent masts, a continuous loading platform, i.e., a continuous passageway along the entire perimeter of the building protected by the perimetric protection, can be formed.

Another advantage, which in this case is of commercial and/or advertising interest, is based on the fact that since the perimetric protection is inclined and projecting, the protective panels assembled thereon can be used as advertising support that will be visible to passers-by or from places located at a level lower than the perimetric protection.

The perimetric protection system of the invention can be self-climbing of the type described in European patent application EP 10382052.8.

As can be seen, the system according to the present invention is simple, can be easily hoisted, adaptable without major changes to different work sites and mode up of combinable modules making the system very versatile.

BRIEF DESCRIPTION OF THE DRAWINGS

To complement the description that is being made and for the purpose of aiding to better understand the features of the invention according to a preferred practical embodiment thereof, a set of drawings is attached as an integral part of said description, in which the following has been depicted with an illustrative and non-limiting character.

DESCRIPTION OF A PREFERRED EMBODIMENT OF THE INVENTION

Figure 1A:
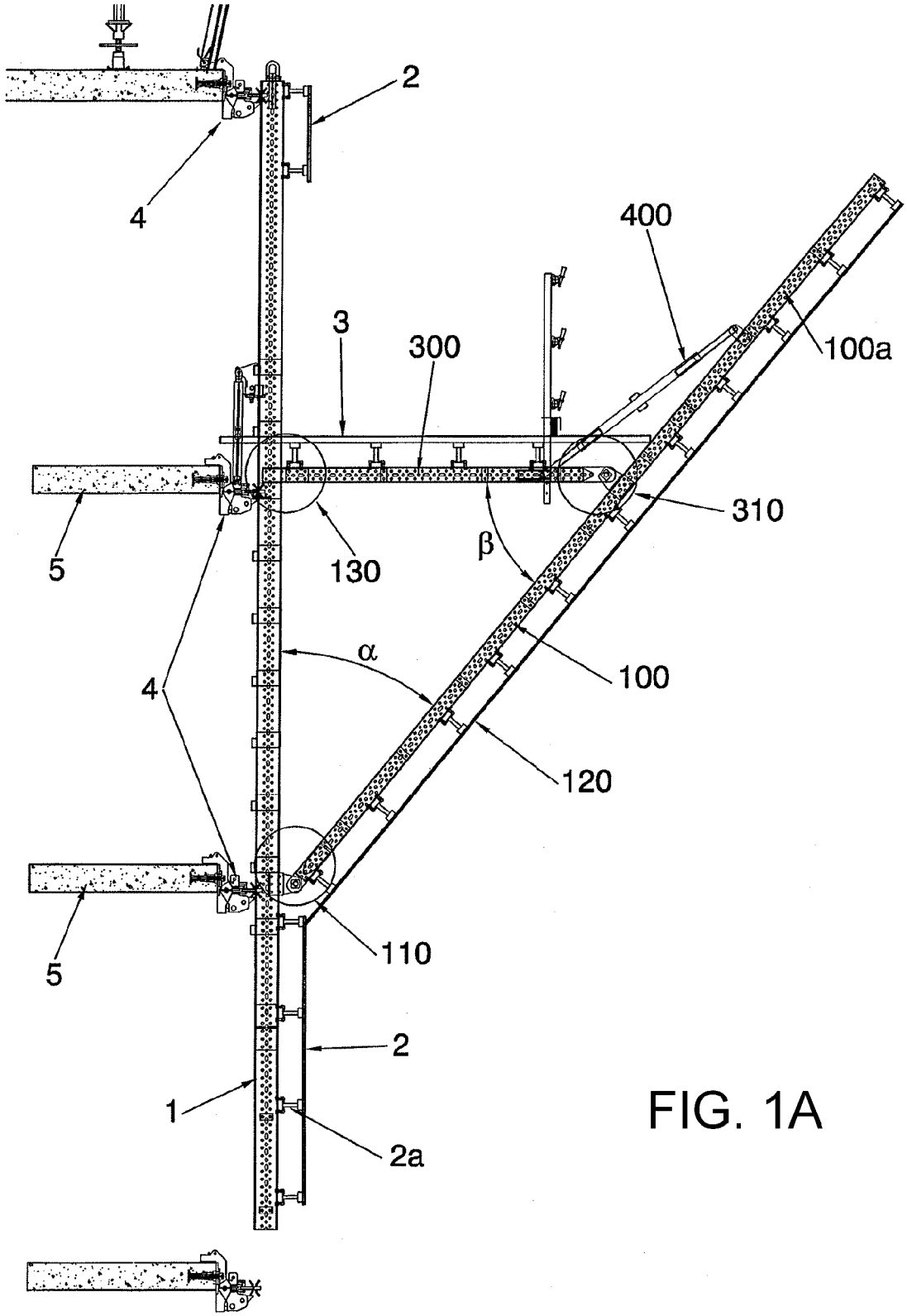
FIG. 1A is a side view of an embodiment of a perimetric protection system according to the present invention.
Figure 1B:
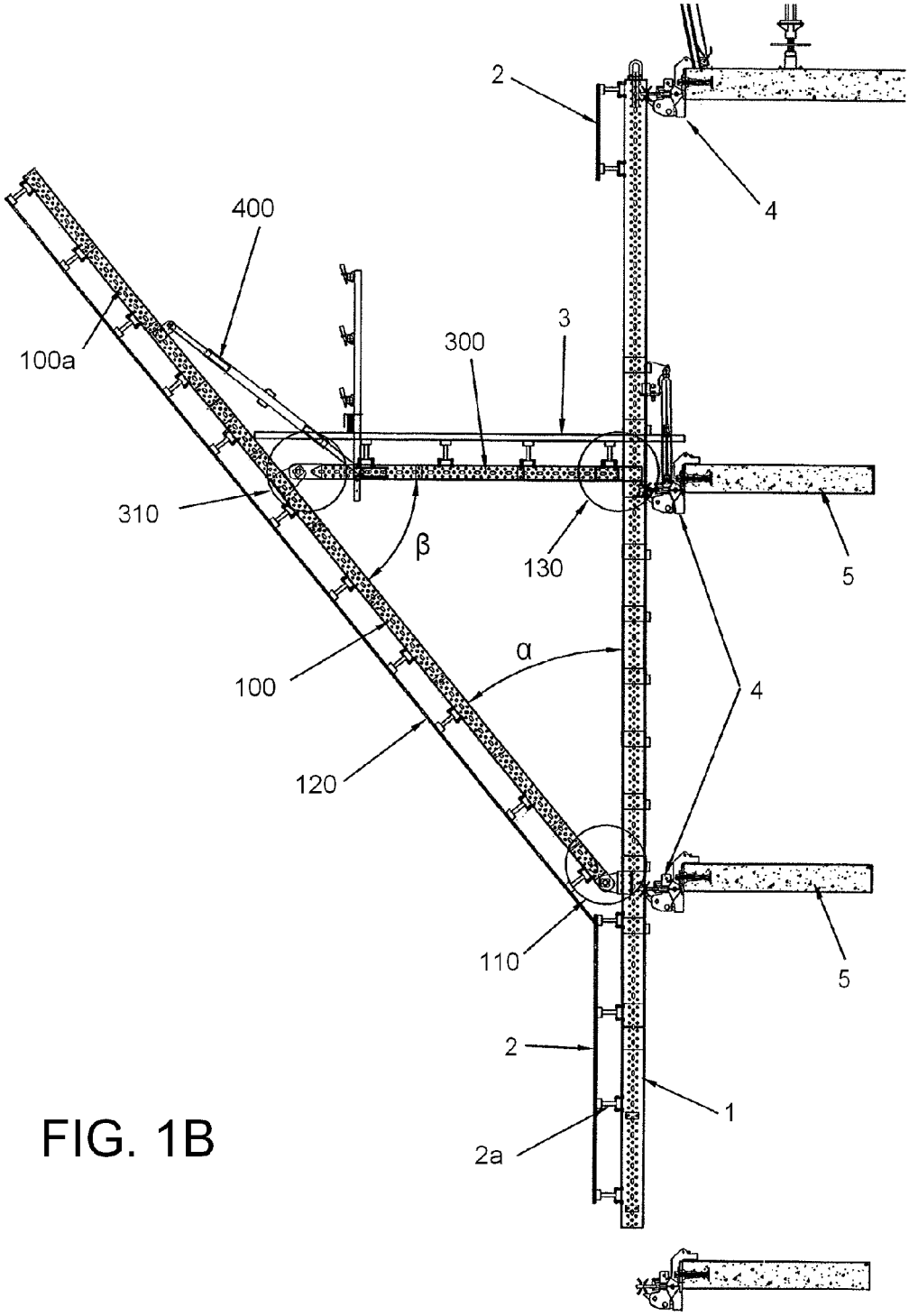
FIG. 1B is another side view of the embodiment shown in FIG. 1A.

FIGS. 1A and 1B show a preferred embodiment of the system according to the present invention, comprising a pair of vertical masts 1, which are supported by heads 4 anchored to the floors 5 of a building. A horizontal loading platform 3, having variable width, which is supported on horizontal beams 300 is assembled on these masts 1; these horizontal beams 300 are attached to the masts 1 by means of first attachment elements or anchors 130. Vertical protective panels 2 are assembled on the masts 1.

Figure 7:
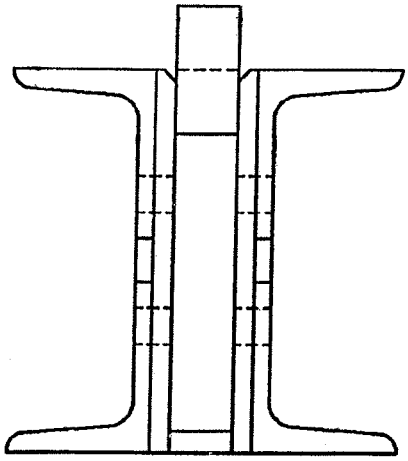
FIG. 7 is a cross-section view of an embodiment of the mast forming part of the present invention.

The masts 1 can be, for example, of the type described in European patent application EP10382052.8, i.e., formed by U-profiles (see FIG. 7) attached at their central branches, between which U-profiles blocks are arranged for supporting the masts in the guiding and supporting heads 4, and which blocks also serve to hoist the masts by means of the hoisting means, such as hydraulic springs.

The heads 4, which allow guiding and supporting the masts 1, are anchored to the respective floors 5, being able to be a front anchor to the floor as shown in FIG. 1A, or an anchor superimposed on the floor (not depicted).

According to the preferred embodiment shown in FIGS. 1A and 1B, the perimetric protection system further includes inclined projecting beams 100 parallel to one another. These inclined beams 100 are attached:

- to the masts 1 by means of second attachment elements 110 forming a first angle $\alpha$;
- to the horizontal beams 300 by means of third attachment elements 310 forming a second angle $\beta$, and they have a length such that after the third attachment elements 310 said inclined beams have a free end 100*a* the height of which exceeds the height of the horizontal platform 3.

Protective panels 120 are coupled to the inclined beams 100 such that there is enough space to place and assemble said loading platform 3 between the floors of the building under construction and the mentioned inclined beams.

These inclined beams are assembled angularly between the masts 1 and the horizontal beams 300, forming a first angle $\alpha$ with the masts 1 and a second angle $\beta$ with the horizontal beams 300 supporting the platform 3.

Figure 2:
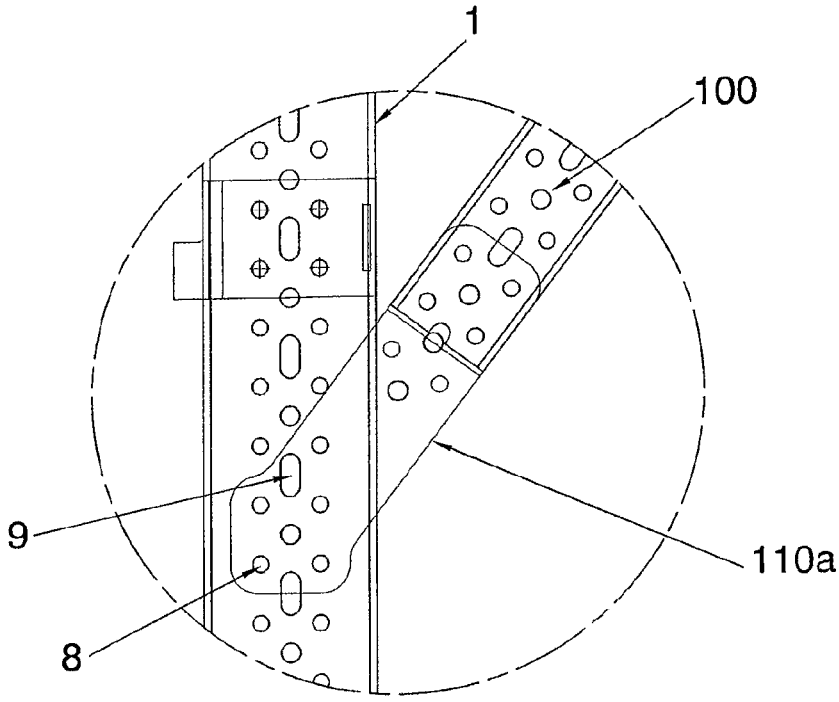
FIG. 2 is a detailed view of a first embodiment of the fixed attachment between mast and inclined beam.
Figure 3:
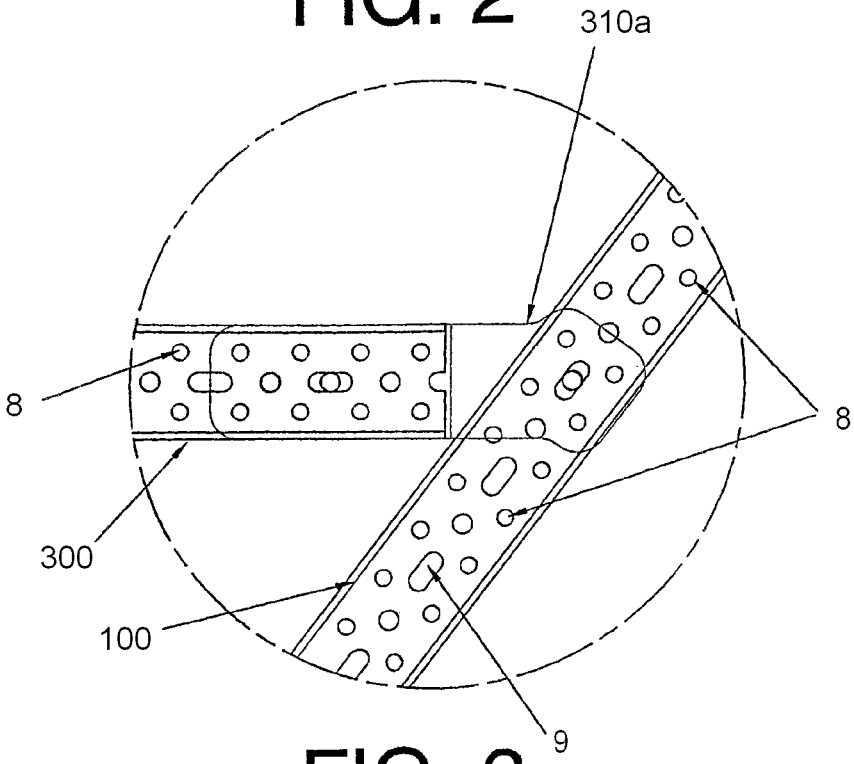
FIG. 3 is a detailed view of a first embodiment of the fixed attachment between inclined beam and horizontal beam.

According to the first embodiment shown in FIGS. 2 and 3, these inclined beams 100 are attached to the masts 1 by means of fixed anchors 110*a*, the first angle $\alpha$ being fixed, and they are attached to the horizontal beams 300 by means of fixed anchors 310*a*, the second angle $\beta$ also being fixed.

The second angle $\beta$ is normally $\pi/2-\alpha$.

Figure 4:
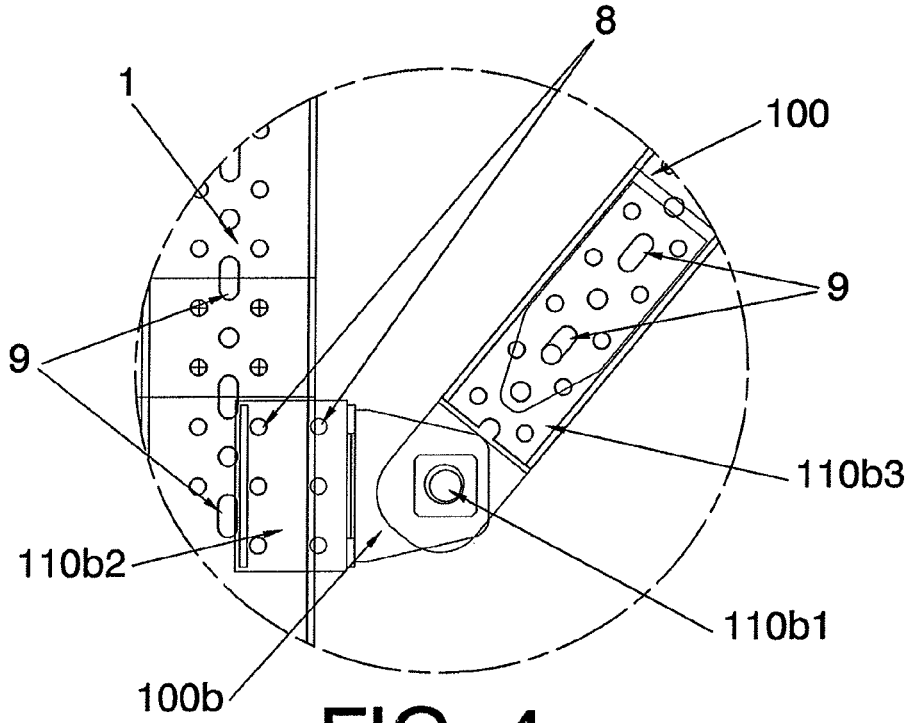
FIG. 4 is a detailed view of a second embodiment of the articulated attachment between mast and inclined beam.
Figure 5:
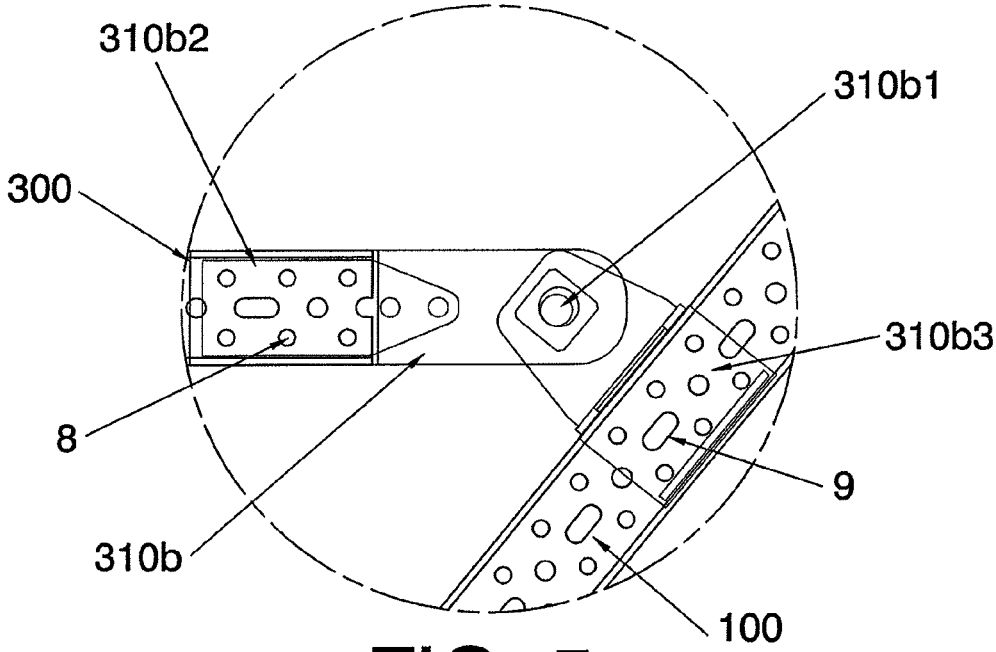
FIG. 5 is a detailed view of a second embodiment of the articulated attachment between inclined beam and horizontal beam.
Figure 6:
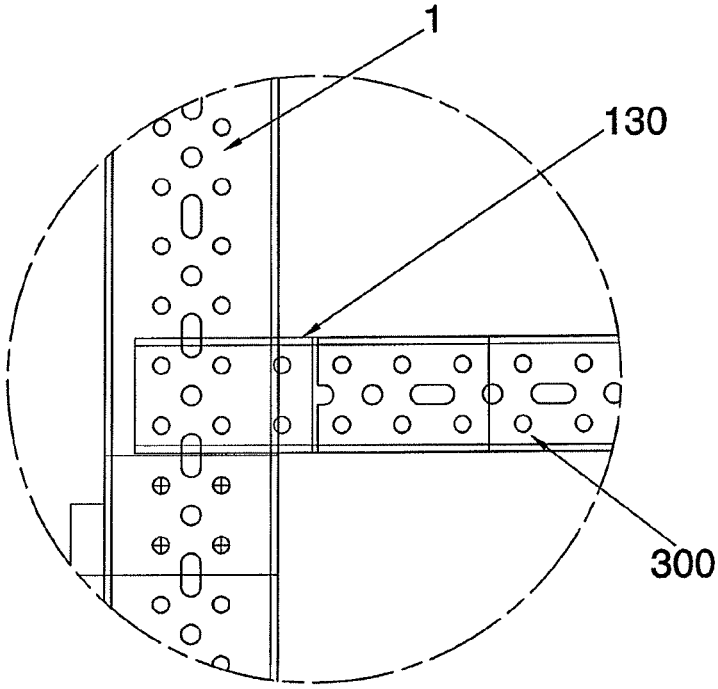
FIG. 6 is a detailed view of a possible attachment between mast and horizontal beam.

According to a second possible embodiment of the invention shown in FIGS. 4-6, the attachment between each inclined beam 100 and the corresponding mast 1 and horizontal beam 3 is by means of an articulated attachment.

Therefore FIG. 4 shows a detail of how the inclined beam 100 is attached at its lower part to the mast 1 by means of an attachment element 110*b*. This attachment element 110*b* includes an articulation 110*b*1 which allows varying the first angle $\alpha$, as well as respective attachment parts 110*b*2 and 110*b*3 which allow the attachment with the regulation thereof to the mast 1 and to the inclined beam 100, respectively.

FIG. 5 similarly shows a detail of how the inclined beam 100 is attached at its upper part to the horizontal beam 300 by means of an attachment element 310*b*. This attachment element 310*b* has an articulation 310*b*1 which allows varying the second angle $\beta$, as well as respective attachment parts 310*b*2 and 310*b*3 which allow the attachment with the regulation thereof to the horizontal beam 300 and to the inclined beam 100, respectively.

FIG. 6 shows a detail of a possible embodiment of the attachment part 130 perpendicular between the mast 1 and the horizontal beam 300.

Like the masts 1, these inclined beams 100 which are angularly assembled are made up of two U-profiles, though somewhat smaller (though they could also be identical).

As can be seen in the details shown in FIGS. 2-6, the masts 1, the inclined beams 100 and the horizontal beams 300 have a series of alignments of circular holes 8 and slit holes 9 for their connection by means of the corresponding screws and/or pins.

The same occurs with the attachment and articulation elements, which also have those alignments of circular holes and slit holes, facilitating their assembly in the beams.

In view of this description and set of drawings, the person skilled in the art will understand that the embodiments of the invention that have been described can be combined in many ways within the object of the invention.

The invention claimed is:

1. A perimetric protection system for a building under construction comprising:

- at least two vertical masts spaced from one another and each formed by two U-profiles;
- at least two horizontal beams each having one end directly attached to a respective vertical mast by a respective first attachment element;
- a loading platform supported on the at least two horizontal beams;
- at least two inclined projecting beams each having one end directly attached to a respective vertical mast, each having a free end, and each being directly attached to a respective horizontal beam at a location between its one end and its free end; and protective panels assembled on the at least two inclined projecting beams;

wherein the free ends of the at least two inclined projecting beams are at a height which exceeds the height of the loading platform, and wherein the loading platform is at least between the at least two inclined projecting beams and the vertical masts, the loading platform at one side being fixed to the at least two masts and at the other opposite side being fixed to the at least two inclined projecting beams.

2. The perimetric protection system according to claim 1, wherein:

the at least two inclined projecting beams are parallel to one another;

each of the at least two inclined beams is attached to a respective mast by means of at least a second attachment element to form a first angle with respect to the respective mast;

each of the at least two inclined beams is attached to a respective horizontal beam by means of at least a third attachment element to form a second angle with respect to the respective horizontal beam.

3. The perimetric protection system according to claim 2, wherein the first angle and the second angle are fixed, and the second attachment elements and the third attachment elements are fixed attachments.

4. The perimetric protection system according to claim 2, wherein the first angle and the second angle are variable, and the second attachment elements and the third attachment elements are articulated attachments.

5. The perimetric protection system according to claim 1, wherein said U-profiles are open towards opposite lateral sides.

6. The perimetric protection system according to claim 1, wherein said at least two inclined beams are each formed by two attached U-profiles open towards opposite sides.

7. The perimetric protection system according to claim 1, wherein the masts, the inclined beams and the horizontal beams have alignments of circular holes and slit holes.

8. The perimetric protection system according to claim 1, further comprising vertical protective panels attached to the at least two masts.

* * * * *